US010843838B2

(12) United States Patent
Beck

(10) Patent No.: US 10,843,838 B2
(45) Date of Patent: Nov. 24, 2020

(54) APPARATUS AND PROCESS FOR APPLYING LABELS TO BOXES

(71) Applicants: XYLO TECHNOLOGIES AG, Niederteufen (CH); I-TeCONSULT N.V., Kortrijk (BE)

(72) Inventor: Wolfgang Beck, Gunzenhausen (DE)

(73) Assignees: XYLO TECHNOLOGIES AG, Niederteufen (CH); I-TeCONSULT N.V., Kortrijk (BE)

( * ) Notice: Subject to any disclaimer, the term of this patent is extended or adjusted under 35 U.S.C. 154(b) by 881 days.

(21) Appl. No.: 14/427,820

(22) PCT Filed: Sep. 24, 2013

(86) PCT No.: PCT/EP2013/069879
§ 371 (c)(1),
(2) Date: Mar. 12, 2015

(87) PCT Pub. No.: WO2014/048934
PCT Pub. Date: Apr. 3, 2014

(65) Prior Publication Data

US 2015/0246743 A1 Sep. 3, 2015

(30) Foreign Application Priority Data

Sep. 28, 2012 (EP) ..... 12405108

(51) Int. Cl.
*B65C 1/02* (2006.01)
*B65C 1/04* (2006.01)
(Continued)

(52) U.S. Cl.
CPC ..... *B65C 1/021* (2013.01); *B65C 1/042* (2013.01); *B65C 1/045* (2013.01); *B65C 9/02* (2013.01);
(Continued)

(58) Field of Classification Search
CPC ..... B65B 41/06; B65B 41/08; B65B 49/00; B65B 49/06; B65B 49/10; B65B 49/14; B65B 11/48; B65C 1/042
See application file for complete search history.

(56) References Cited

U.S. PATENT DOCUMENTS 1,536,837 A * 5/1925 Fredsell ..... B65C 9/36 156/490
2,280,730 A 4/1942 Talbot
(Continued)

FOREIGN PATENT DOCUMENTS

CN 1795125 A 6/2006
DE 98 065 C 7/1898
(Continued)

OTHER PUBLICATIONS

Translation of communication dated Sep. 28, 2015, issued by the State Intellectual Property Office of the P.R.C. in corresponding Chinese Application No. 201380051061.4.
(Continued)

*Primary Examiner* — Barbara J Musser
(74) *Attorney, Agent, or Firm* — Sughrue Mion, PLLC

(57) ABSTRACT

An apparatus for and a process of applying labels to boxes are disclosed. A box (1) is received in a labeling zone. A label carrier (30) is vertically moveable relative to the labeling zone to place the center portion of a label (5) onto the upper side of the box. Two presser elements (21, 21') arranged on two mutually opposite lateral sides of the labeling zone are downwardly moveable both relative to the labeling zone and relative to the label carrier so as to fold and apply end portions of the label onto the lateral sides of the box.

20 Claims, 4 Drawing Sheets

(51) Int. Cl.

| | |
|---|---|
| ***B65C 9/02*** | (2006.01) |
| ***B65C 9/14*** | (2006.01) |
| ***B65C 9/20*** | (2006.01) |
| ***B65C 9/36*** | (2006.01) |
| *B65B 49/00* | (2006.01) |

(52) U.S. Cl.
CPC ..... *B65C 9/14* (2013.01); *B65C 9/20* (2013.01); *B65C 9/36* (2013.01); *B65B 49/00* (2013.01); *Y10T 156/1051* (2015.01); *Y10T 156/17* (2015.01); *Y10T 156/1783* (2015.01)

(56) References Cited

U.S. PATENT DOCUMENTS

| | | | | | |
|---|---|---|---|---|---|
| 3,762,129 | A * | 10/1973 | Salomon | B65B 5/08 | 53/242 |
| 4,838,846 | A * | 6/1989 | Focke | B65B 51/026 | 493/132 |
| 4,895,614 | A * | 1/1990 | Trouteaud | B65C 1/023 | 156/542 |
| 4,950,351 | A * | 8/1990 | Young | B65C 1/045 | 156/475 |
| 4,956,961 | A * | 9/1990 | Janhonen | B65B 13/02 | 53/176 |
| 5,009,741 | A * | 4/1991 | Focke | B65C 1/042 | 156/483 |
| 5,209,808 | A * | 5/1993 | Booth | B65C 1/042 | 156/468 |
| 5,300,181 | A * | 4/1994 | Yamaguchi | B65C 1/042 | 156/542 |
| 5,356,508 | A * | 10/1994 | Watanabe | B65C 1/042 | 156/475 |
| 5,370,754 | A * | 12/1994 | Soloman | B65C 1/045 | 156/361 |
| 5,421,948 | A | 6/1995 | Crankshaw et al. | | |
| 5,645,669 | A * | 7/1997 | Crankshaw | B65C 1/04 | 156/212 |
| 5,720,156 | A * | 2/1998 | Bridges | B65B 5/024 | 53/168 |
| 5,865,918 | A * | 2/1999 | Franklin | B65C 9/1826 | 156/363 |
| 6,438,927 | B1 * | 8/2002 | Focke | B65C 1/04 | 53/415 |
| 6,516,854 | B1 * | 2/2003 | Tsai | B65C 9/1884 | 156/361 |
| 6,884,312 | B2 * | 4/2005 | Mitchell | B41J 3/4075 | 156/256 |
| 7,462,252 | B2 * | 12/2008 | Schaller | B65C 1/045 | 156/202 |
| 7,789,226 | B2 * | 9/2010 | Carrigan | B65B 5/105 | 206/215 |
| 7,946,330 | B2 * | 5/2011 | Spatafora | B65C 1/023 | 156/475 |
| 2002/0050130 | A1 * | 5/2002 | Grossmann | B65B 19/223 | 53/574 |
| 2003/0075277 | A1 * | 4/2003 | Vogt | A61F 13/15756 | 156/519 |
| 2003/0140597 | A1 * | 7/2003 | Spatafora | B65B 49/14 | 53/210 |
| 2003/0146271 | A1 * | 8/2003 | Furini | B65B 9/2049 | 229/125.15 |
| 2007/0102109 | A1 * | 5/2007 | Katritzky | B65C 1/042 | 156/277 |
| 2008/0303666 | A1 * | 12/2008 | Abe | B65C 1/042 | 340/572.1 |
| 2009/0193763 | A1 * | 8/2009 | Fontanazzi | B65B 49/08 | 53/456 |

FOREIGN PATENT DOCUMENTS

| | | | | |
|---|---|---|---|---|
| DE | 487 767 | C | 12/1929 | |
| DE | 2702482 | A1 | 7/1978 | |
| DE | 197 06 317 | A1 | 9/1998 | |
| EP | 1145962 | A1 * | 10/2001 | B65C 1/04 |
| EP | 1 177 982 | A1 | 2/2002 | |
| KR | 100794708 | B1 | 1/2008 | |
| RU | 2257316 | C2 | 7/2005 | |
| SU | 97510 | A1 | 11/1953 | |
| SU | 1237566 | A1 | 6/1986 | |

OTHER PUBLICATIONS

Communication dated Jan. 16, 2017, from the Russian Patent Office in counterpart Russian application No. 2015113748/12.
Communication dated Feb. 12, 2015, issued by the European Patent Office in counterpart European application No. 12 405 108.7.
International Search Report for PCT/EP2013/069879 dated Dec. 18, 2013.
Written Opinion for PCT/EP2013/069879 dated Dec. 18, 2013.

* cited by examiner

APPARATUS AND PROCESS FOR APPLYING LABELS TO BOXES

TECHNICAL FIELD

The present invention relates to an apparatus and to a process for applying labels to boxes, preferably rectangular, cuboid boxes that may be made of cardboard, at high speeds. The invention is especially useful for applying labels that are intended to be simultaneously visible on three sides of a box, such as on the top side and on two longitudinal sides. The boxes may be used to package laminate flooring panels in particular, but may also be used for any other products. The invention is also especially useful for applying labels to lidless boxes containing products and which are intended to be shrink-wrapped subsequently.

PRIOR ART

Many products today are sold in boxes and especially in rectangular, cuboid cardboard boxes. It is often desirable that the products are visible to a prospective customer, so that open boxes, i.e. boxes without lids are preferred. Such open (lidless) boxes are often preprinted on their sides with various information about the manufacturer, the product and often also about the seller or retailer. Especially with boxes for laminate flooring panels, a flyer describing details of the product, such as instructions, is added into the box, on top of the boxed product before the box with the product and the flyer are then shrink-wrapped subsequently. It is a great disadvantage of such prior art, that the flyer is visible only from the top side of such a box, especially when such boxes are stacked to piles at a retailer. All information which is desired to be seen on the sides of such prior art boxes must either be pre-printed to such a box, or it must be added by the application of two additional side labels. Preprinting information to the sides of boxes can limit the flexible use of such boxes, and thus can add considerably to logistics problems and costs, for example when new products would not match older existing boxes, such that new boxes would have to be pre-printed. This can be avoided by flexibly gluing labels as needed for a specific distributor or for a specific market or product to the sides of such boxes. However additionally gluing labels to the sides of such boxes adds costs as well as quality control issues to such additional steps, for example the correct position and the sufficient adhesion of such additional labels must be ensured and monitored.

U.S. Pat. No. 5,865,918 mentions some of the above problems and offers a solution by providing a machine which is capable of applying labels simultaneously to more than one side of a box. However, the solution of U.S. Pat. No. 5,865,918 demands the preparation of different labels for the different box sides to be labeled, which increases costs and adds unnecessary complexity.

Other patents, such as U.S. Pat. No. 5,421,948 recognize that it can be necessary or desirable to apply a single label to multiple sides of an article. It does this by providing—among other things—a label carrier being mounted for rotation on a carrier mount. When an article is transported along the transportation means, a label is rolled and thus applied to an article onto several sides of an article. The methods disclosed in U.S. Pat. No. 5,421,948 and other documents such as EP 1,177,982 however have the disadvantage that they can only apply labels in the general direction of transport, and more importantly, that the label is necessarily also glued onto the top side of the article or box.

However, if it is intended to apply labels onto an open box which already contains a product or products—such as flooring panels—it is highly undesirable that the label is glued or is attached by an adhesive to the upper side of the box, which consists of the product. This would not only be a waste of glue or adhesive, it mainly would mean that a customer would have to tediously remove the adhesive or glue from the product when the product is unpacked from the box.

SUMMARY OF THE INVENTION

It is an object of the present invention to provide an apparatus and a corresponding process for applying a label to a box in such a manner that the label is visible from different viewing directions. Application should be fast and efficient, and it should be possible to apply the label in such a manner that no adhesive is applied to a selected portion of the box.

This object is achieved by an apparatus according to claim 1 and by a process according to claim 13. Further embodiments of the invention are laid down in the dependent claims.

In a first aspect, the present invention provides an apparatus for applying labels to boxes. The apparatus defines a labeling zone for receiving a box having an upper side and having first and second opposing lateral sides. The apparatus comprises a label carrier for releasably carrying a label having a center portion and a first and second end portion, the label carrier being vertically moveable relative to said labeling zone to place the center portion of the label onto the upper side of a box received in the labeling zone. The apparatus further comprises a pressing assembly comprising two presser elements arranged on two mutually opposite lateral sides of the labeling zone, the presser elements being downwardly moveable both relative to the labeling zone and relative to the label carrier so as to fold the first and second end portions of the label onto the first and second lateral sides of the box.

By lowering the label carrier onto the box and subsequently moving the presser elements downward, the apparatus wraps and folds the label around three sides of the box in a single, rapid downward movement.

Advantageously, the label is not only folded, but simultaneously also applied to the lateral sides of the box by the downward movement of the presser elements. To this end, the presser elements may exert lateral pressure to the lateral sides of the box already during their downward movement. In a less preferred alternative, it is also conceivable that the presser elements are moved inward towards the lateral sides of the box to reduce their distance, so as to exert pressure to these lateral sides only after the presser elements have reached a lower end position. In both situations, pressure should be released before the presser elements are moved upward again at the end of the labeling process. For this purpose, the presser elements are preferably moveable along a lateral direction relative to the labeling zone away from the first and second lateral sides of the box to increase a distance between the presser elements. A pressure release mechanism may be provided to this end. This mechanism may, e.g. comprise pneumatic cylinders moving the presser elements to increase a distance between the presser elements.

The label carrier and the pressing assembly are preferably part of a labeling head that is moveable as a whole relative to the labeling zone. In particular, the labeling head may be moveable horizontally.

The apparatus may comprise a label reservoir or magazine for holding a stack of labels. The labeling head is then preferably horizontally moveable between a position above the label reservoir and a position above the labeling zone. The direction of this movement may be the lateral direction, but also other directions are possible, in particular, a horizontal direction perpendicular to the lateral direction is conceivable. For effecting the movement, the label carrier may be mounted on a sleigh assembly. The sleigh assembly may be moved by any suitable actuating device, such as a chain drive driven by an electric motor, or by a pneumatic drive.

Each presser element may define a straight, longitudinal, smooth contact surface configured to slide along one of the first and second lateral sides of a box received in the labeling zone when the presser elements move downward relative to the labeling zone. In this manner, the presser elements can exert lateral pressure to portions of the lateral sides of the box already during their downward movement. The contact surface preferably has the shape of a rounded, horizontally extending edge.

To create the desired pressure onto the lateral sides of the box, the presser elements can be elastically biased inwardly, towards the lateral sides of the labeling zone, by suitable spring elements, or they may be made of a resilient material so as to exert an elastic, inwardly directed pressing force. In particular, the each presser element can be made of a sheet of resilient material, in particular, of a metal like stainless steel or aluminum. The presser elements may then have a lateral distance that is slightly smaller than the distance between the first and second lateral sides of the box.

If the presser elements are made of a sheet of resilient material, the contact surface can be defined by providing a longitudinal notch in the form of a kink in each presser element. The cross-section of the notch and correspondingly the cross-section of the resulting contact surface can be U- or V-shaped.

For enabling easy pick-up and release of the labels, the label carrier may comprise a vacuum suction arrangement for carrying the labels by vacuum action. The vacuum suction arrangement may comprise a plurality of vacuum cups arranged in at least a first and a second row extending along the lateral direction.

To ensure that not only the center portion of the labels is held by the vacuum suction arrangement, but that also the end portions are held, a particular arrangement of the vacuum cups is preferred as follows. Each presser element has a length between a first and a second end thereof along a horizontal longitudinal direction perpendicular to the lateral direction. It is then preferred that the first and second rows of vacuum nozzles have a distance that is larger than said length, and that the first and second rows of vacuum cups extend, along the lateral direction, beyond the ends of the presser elements. In this manner the vacuum cups can also hold the end portions of the label.

The apparatus may further comprise a transportation device for transporting boxes along a transportation direction to the labeling zone, e.g. a conveyor belt or a series of rollers. A stopper device may be provided for stopping movement of a box once it is received in the labeling zone. The stopper device may comprise a structure moveable in a direction transverse to the transportation direction into the transport path of the boxes to prevent further movement of a box.

The apparatus may further comprise an adhesive application device for applying adhesive to the first and second lateral sides of the box. The adhesive application device may comprise at least a first and a second spray nozzle, the first spray nozzle being configured to apply adhesive to a first lateral side of a box received in the labeling zone, and the second spray nozzle being configured to apply adhesive to a second lateral side of a box received in the labeling zone. In alternative embodiments, adhesive may be applied to the labels instead of the lateral sides of the boxes.

The apparatus may further comprise an alignment device for laterally aligning a box received in the labeling zone, the alignment device comprising structures to press onto the first and second lateral sides of said box.

In a second aspect of the present invention, a process of applying a label to a box having an upper side and having first and second opposing lateral sides is provided. The process comprises the following steps, not necessarily in the present order:

- transporting the box to a labeling zone;
- fetching a label having a center portion and a first and second end portion from a label reservoir;
- positioning the label above the box so that the first and second end portion laterally project beyond the lateral sides of the box;
- placing the center portion of the label onto the upper side of the box; and
- folding the first and second end portions of the label onto the first and second lateral sides of the box by moving two presser elements arranged on two mutually opposite lateral sides of the labeling zone downward along the first and second lateral sides of the box.

To ensure the label is not only folded, but simultaneously also applied to the lateral sides of the box by the downward movement of the presser elements, the presser elements may exert lateral pressure to the lateral sides of the box already during their downward movement. To this end, the presser elements may be elastically deformable or be inwardly spring-biased and have a lateral distance that is slightly smaller than the distance between the first and second lateral sides of the box. In alternative embodiments, pressure may be exerted only after the downward movement of the presser elements has finished.

The process advantageously further comprises:

- releasing pressure from the lateral sides of the box by increasing the distance of the presser elements along a lateral direction relative to the labeling zone away from the first and second lateral sides of the box.

In advantageous embodiments of the process, no adhesive is applied between the upper side of the box and the center portion of the label.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
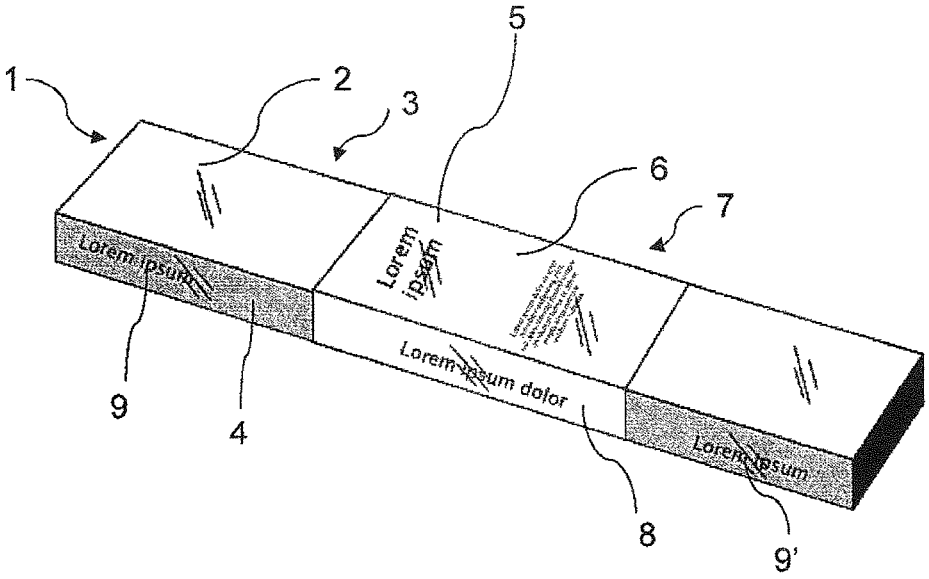
FIG. 1 shows a box after having been labeled by the apparatus and process according to the present invention and subsequently having been shrink-wrapped.

FIG. 1 shows a box 1 labeled by an apparatus and a process according to the present invention. Preferably, the box 1 is an open box, "open" in this context meaning open to its upper side 2, and the box 1 already contains a product or a plurality of products before entering the labeling machine. The box 1 may optionally include preprinted elements such as information 9, 9' on its lateral sides 3 and 4 or optionally also on its two head sides. The labels 5 are preferably made of paper which is preferably preprinted in a manner which allows information to simultaneously be viewed from three different sides once the label is attached to the box. Paper with a weight of 90 grams per square meter has proven good results. The labels 5 are placed on the upper side 2 of the box 1 and extend along two lateral sides 3 and 4 of the box 1. Glue is applied only to portions of the lateral sides 3 and 4.

Figure 2:
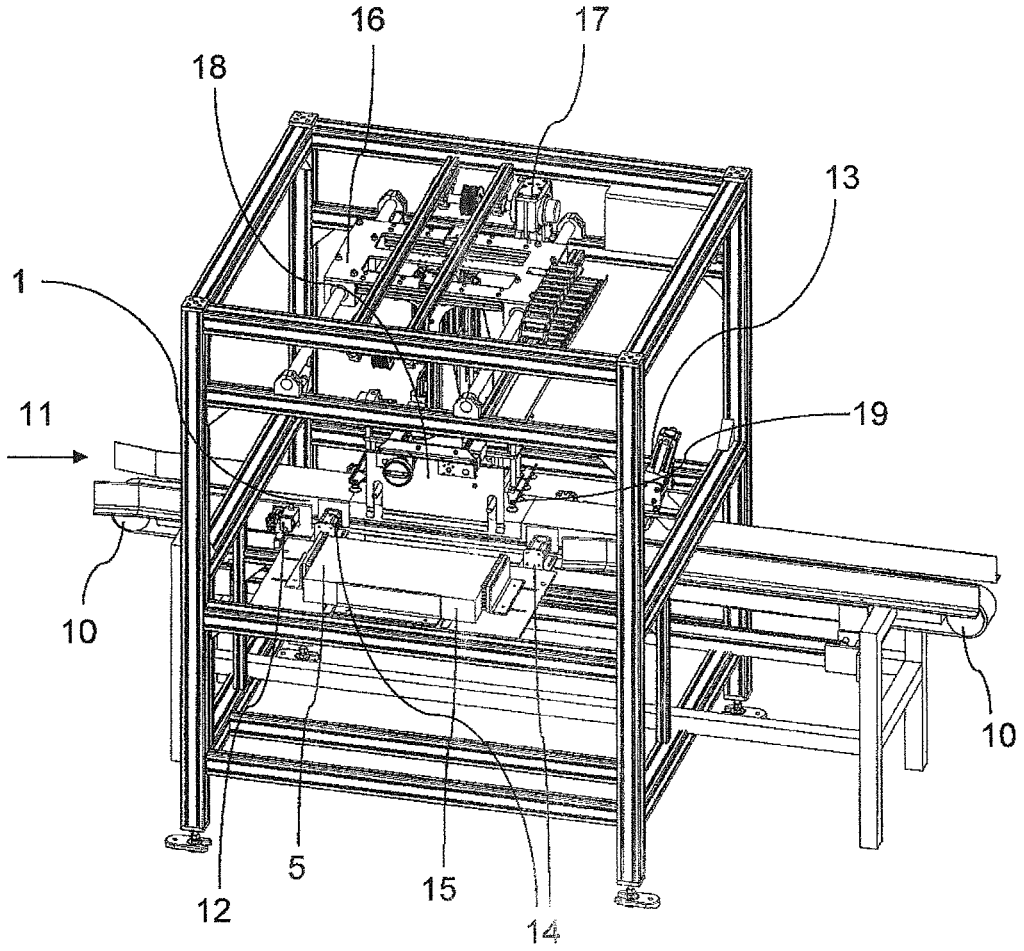
FIG. 2 shows a schematic view of an apparatus according to a preferred embodiment of the present invention.
Figure 3:
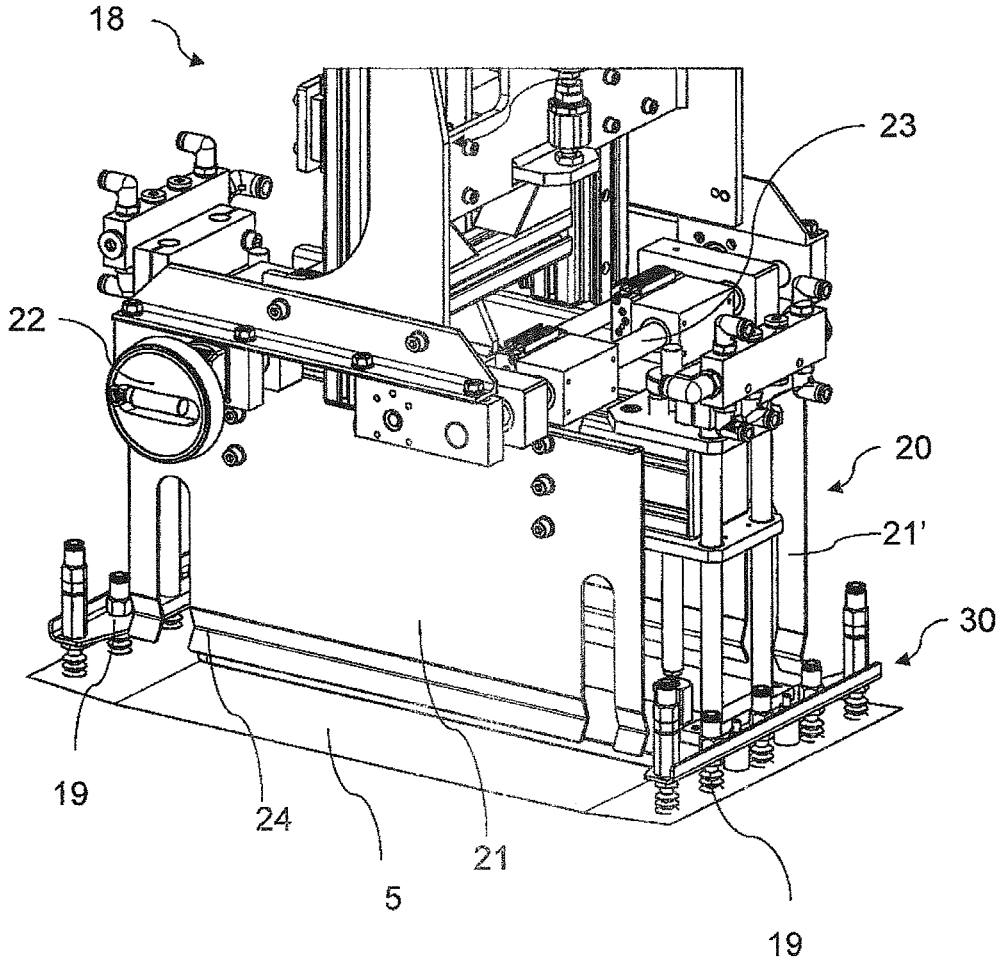
FIG. 3 shows a schematic view of a labeling head assembly after having pre-fetched a label.
Figure 4:
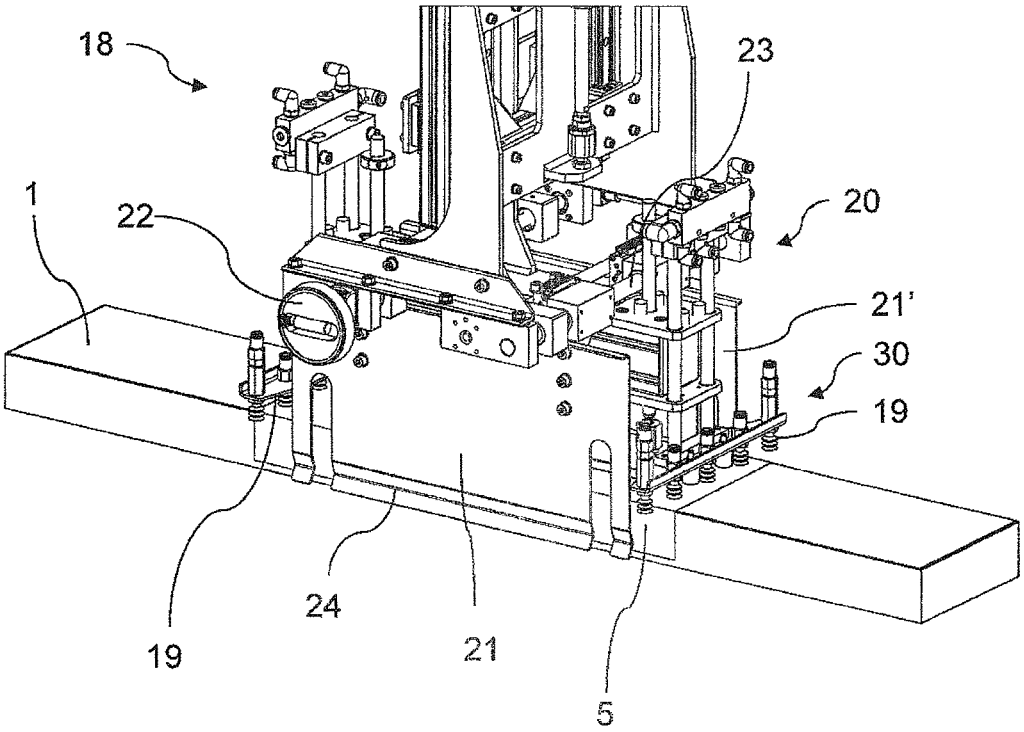
FIG. 4 shows a schematic view of the labeling head assembly after having positioned, wrapped and folded the label and after having pressed the label onto the pre-glued surfaces.

The application of a label 5 to a box 1 is illustrated in FIGS. 2-4. The boxes 1 are fed through the labeling apparatus along a horizontal transport direction 11 by a transportation device 10. For the labeling of a box 1, the box 1 is stopped and aligned in a labeling zone. In a first step, a label 5 is fetched and moved over the labeling zone. This is achieved by a sleigh assembly 16 which is moved laterally, in a direction essentially perpendicular to the transport direction 11, by a servo motor 17. Attached to said sleigh assembly 16 is a vertically displaceable labeling head assembly 18, which comprises a label carrier 30 including a vacuum suction arrangement and a pressing assembly 20 including two presser elements 21, 21'. While these two presser elements 21, 21' can comprise any useful means to elastically apply pressure to a surface, such as rollers or displaceable presser pads, a simple construction in the form of two presser sheets is preferred, as shown in FIGS. 2-4.

The vacuum suction arrangement comprises vacuum cups 19, here two rows of five vacuum cups each, one row for the leading end and one row for the trailing end of the label 5. Additional suction vacuum cups can also be employed in the middle of a label 5, but are not shown in the Figures. A vacuum is preferably simultaneously supplied or released to all cups through a piping manifold.

The labeling head assembly 18 is positioned over a label reservoir (label magazine) 15. The labeling head assembly 18 is then lowered onto the topmost label 5 in the label reservoir 15; the vacuum suction arrangement is activated in order to attach the topmost label 5 to the label carrier 30. The labeling head assembly 18 is then lifted and transported horizontally, in the lateral direction, which is essentially perpendicular to the transport direction 11, by the sleigh assembly 16 over the labeling zone where a box 1 has been or will be positioned and aligned. This situation is illustrated in FIG. 3.

As already mentioned, a box 1 to which a label 5 shall be added is transported into the labeling zone by a transportation device 10 in the transport direction 11. The transportation device 10 preferably comprises a conveyor belt, but may also consist of a series of rolls or of an air cushion transportation device. When a box 1 nears the labeling zone, a light barrier or another suitable detection device is triggered and the box 1 is decelerated by electronics controlling the transportation device 10. The light barrier or other detection device also triggers preferably two adhesive application devices 12 to apply an adhesive to the two lateral sides 3 and 4 of the box 1. In a preferred embodiment, the adhesive application devices 12 comprise two spray nozzles, one at each of the two lateral sides 3 and 4, which preferably apply hot glue to the two lateral sides 3 and 4 of the box 1.

At the end of the deceleration phase, a preferably pneumatically activated stopper 13 blocks transportation of the box 1 in the transport direction 11. The stopper 13 is preferably positioned such that the label 5 will be applied in the middle of the length of the box 1 for mainly esthetical reasons, but can of course be positioned differently as desired.

After the stopper 13 has been activated, a lateral alignment device 14 is activated. The lateral alignment device 14 preferably consists of four preferably pneumatically activated cylinders and pistons, which precisely position the box 1 laterally, so that the label 5 will be applied at the correct lateral position of the box 1.

When the box 1 is in place, the entire labeling head assembly 18 including the label carrier 30 and the pressing assembly 20 is lowered.

In a first phase of this continuous downward movement, the central portion 6 of the label 5 is placed onto the upper side 2 of the box 1. The downward movement of the label carrier 30 is stopped when it makes contact with the box 1, and the vacuum in the vacuum suction arrangement 19 is broken. At this moment, the label is held in place by the mechanical pressure of the label carrier 30 pressing onto the central portion 6 of the label 5.

In the second phase of this continuous downward movement, the pressing assembly 20, comprising the presser elements 21, 21', continues its downward movement now with a relative movement against the stopped label carrier 30. By the downward movement of the pressing assembly 20 the presser elements 21 and 21' continue to slide down the lateral sides 3 and 4 of the box 1. By this sliding motion of the presser elements 21 and 21', the label 5 is simultaneously wrapped and folded around the box 1 and the first and second ends 7 and 8 of the label 5 are pressed onto the pre-glued surfaces of the box 1. The situation at the end of this movement is illustrated in FIG. 4. The application of a label. 5 by such a single wrapping, folding and pressing downward movement has proven to be very rapid, efficient and economic.

The pressing is achieved by pre-adjusting the right distance between the presser elements 21, 21'. The distance between the presser elements 21, 21' remains constant during the label-fetching and during the downward movement of the label carrier and the pressing assembly 20. The presser elements 21, 21' should preferably exercise just the right amount of pressure in order to reliably press the first and second label end portions 7 and 8 onto the pre-glued surfaces: Too much pressure might rip the label 5 apart and too little pressure might not ensure sufficient adhesion. This is why the distance of the presser elements 21, 21' is pre-set by a distance regulation device 22, such as a hand-wheel, which drives a spindle that symmetrically moves the presser elements 21, 21' perpendicularly to the transport direction 11. The distance regulation device 22 not only serves to adjust the right amount of pressure of the presser elements 21, 21', is also serves to rapidly adjust the apparatus for batches with different box widths.

Once the label 5 has been folded, wrapped and pressed onto its pre-glued surfaces, a presser release mechanism 23 is activated and increases the horizontal distance between the presser elements 21, 21' and the box 1, before the labeling head assembly 18 is moved upward again. This horizontal release movement helps to avoid that the label sides 7 and 8 are damaged or moved out of their position when the labeling head assembly 18 is moved upward.

Preferably the presser release mechanism 23 is activated and controlled by pneumatic cylinders.

In the present embodiment, the presser elements 21, 21' are made of a sheet of resilient material such as metal, preferably aluminum or steel. Such a resilient material allows for a spring-like force of the presser elements 21, 21' to press the sides 7, 8 of the label 5 onto the pre-glued surfaces. Each presser element has, slightly above its lower horizontal edge, a horizontal, U- or V-shaped notch 24 in the form of a kink, which provides a well-defined, narrow, smooth contact surface for pressing the first and second ends 7 and 8 of the label 5 onto the pre-glued surface.

Once the presser release mechanism 23 has been activated, the labeling head assembly 18 with the label carrier and pressing device 20 is moved upward, the pressing device 20 is restored to its initial position relative to the label carrier, the stopper 13 is deactivated, the transportation device 10 is activated and the now labeled box 1 moves out of the apparatus, ready to subsequently be shrink wrapped. The labeling head assembly 18 is then moved back over the label magazine 15 and the cycle is repeated for the next box 1.

While preferred embodiments of the present invention have been described, many modifications are possible without leaving the scope of the present invention. In particular, it is conceivable to move the presser elements downward while they have a larger distance than the width of the box, so as to initially only fold down the end portions of the label, without any pressing action, and only then to exert pressure laterally by reducing the distance between the presser elements. The label carrier can comprise different vacuum suction means than those described above, e.g., vacuum suction means such as those disclosed in U.S. Pat. No. 5,865,918. Entirely different means for holding a label, e.g. means for holding the label by electrostatic forces, may be used instead. Instead of applying adhesive to the lateral sides of the box, adhesive may be applied to the end portions of the label instead. Alternatively, the labels may be pre-coated with adhesive, e.g., with pressure-sensitive adhesive. The boxes may be transported in an entirely different manner than described above, e.g., by a robot arm. Whereas in the above example the lateral direction (as defined by the lateral sides of the box to which the label is applied) is perpendicular to the transport direction, these two directions can be identical. In particular, it is conceivable that the boxes are transported in a direction that corresponds to the direction of movement of one of the presser elements during pressure release. The boxes need not be of cuboid shape as long as they have two opposite side faces. The side faces need not be flat if suitable presser elements are employed.

| List of Reference Signs | |
|---|---|
| 1 | Box |
| 2 | Upper side of box |
| 3 | Lateral side of box |
| 4 | Lateral side of box |
| 5 | Label |
| 6 | Upper side of label |
| 7 | Lateral side of label |
| 8 | Lateral side of label |
| 9, 9' | Preprinted information |
| 10 | Transportation device |
| 11 | Transport direction |
| 12 | Adhesive application device |
| 13 | Stopper |
| 14 | Lateral alignment device |
| 15 | Label magazine |

-continued

| List of Reference Signs | |
|---|---|
| 16 | Sleigh assembly |
| 17 | Servo motor |
| 18 | Labeling head |
| 19 | Vacuum suction arrangement |
| 20 | Pressing assembly |
| 21, 21' | Presser element |
| 22 | Distance regulation device |
| 23 | Presser release mechanism |
| 24 | U-shaped notch |
| 30 | Label carrier |

The invention claimed is:

1. An apparatus for applying labels to boxes, the apparatus defining a labeling zone for receiving a box having an upper side and having first and second opposing lateral sides, the apparatus comprising:

a label carrier for releasably carrying a label having a center portion and a first and second end portion, the label carrier being configured to be vertically moved along a vertical direction relative to said labeling zone to place the center portion of the label onto the upper side of a box received in the labeling zone;

a pressing assembly comprising two presser elements arranged on two mutually opposite lateral sides of the labeling zone, the presser elements being configured to be downwardly moved along the vertical direction both relative to the labeling zone and relative to the label carrier so as to fold the first and second end portions of the label onto the first and second lateral sides of the box, and a presser release mechanism, wherein the presser elements are further configured to be moved along a lateral direction running perpendicularly to the vertical direction relative to the labeling zone away from the first and second lateral sides of the box to increase a distance between the presser elements and to thereby release pressure from the first and second lateral sides of the box, wherein the presser release mechanism is configured to increase a horizontal distance between the presser elements such that in each case a lateral distance between the presser elements and the corresponding first lateral side and second lateral side of the box is increased equally over an entire length of the presser elements before the presser elements are moved upward again, and wherein the presser elements are configured to be moved upward along the vertical direction while the presser elements are at said horizontal distance.

2. The apparatus of claim 1, wherein the label carrier and the pressing assembly are part of a labeling head that is moveable as a whole relative to the labeling zone.

3. The apparatus of claim 2, further comprising:

a label reservoir for holding a stack of labels, wherein the labeling head is horizontally moveable between a position above the label reservoir and a position above the labeling zone.

4. The apparatus of claim 1, wherein each presser element defines a straight, longitudinal, smooth contact surface configured to slide along one of the first and second lateral sides of a box received in the labeling zone when the presser elements move downward relative to the labeling zone.

5. The apparatus of claim 1, wherein each presser element is made of a sheet of resilient material.

6. The apparatus of claim 5, wherein each presser element has a longitudinal notch defining a narrow, straight, longitudinal contact surface configured to slide along one of the first and second lateral sides of a box received in the labeling zone when the presser elements move downward relative to the labeling zone.

7. The apparatus of claim 5, wherein the resilient material is a metal.

8. The apparatus of claim 1, wherein the label carrier comprises a vacuum suction arrangement for carrying a label by vacuum action.

9. The apparatus of claim 8, wherein the vacuum suction arrangement comprises a plurality of vacuum cups arranged in at least a first and a second row extending along the lateral direction.

10. The apparatus of claim 9, wherein each presser element has a length between a first and a second end thereof along a horizontal longitudinal direction perpendicular to the lateral direction, wherein the first and second rows of vacuum cups have a distance that is larger than said length, and wherein first and second rows of vacuum cups extend, along the lateral direction, beyond the ends of the presser elements so as to hold the first and second end portions of the label.

11. The apparatus of claim 1, further comprising:

a transportation device for transporting boxes along a transportation direction to the labeling zone; and a stopper device for stopping movement of a box once it is received in the labeling zone.

12. The apparatus of claim 1, further comprising:

an adhesive application device for applying adhesive to the first and second lateral sides of the box.

13. The apparatus of claim 12, wherein the adhesive application device comprises at least a first and a second spray nozzle, the first spray nozzle being configured to apply adhesive to a first lateral side of a box received in the labeling zone, and the second spray nozzle being configured to apply adhesive to a second lateral side of a box received in the labeling zone.

14. The apparatus of claim 1, wherein the presser elements are elastically biased inwardly towards the first and second lateral sides of the labeling zone by a spring element.

15. The apparatus of claim 14, wherein a lateral distance between the presser elements is smaller than a distance between the first and second laterals sides of the box during a downward movement of the pressure elements.

16. The apparatus of claim 1, wherein at least one of:

i) the apparatus further comprises a pressure release mechanism comprising one or more pneumatic cylinders that are configured to move the presser elements such, that a horizontal distance between the presser elements is increased, and/or ii) the apparatus further comprises a distance regulation device and a spindle, wherein the distance regulation device is configured to drive the spindle such that the presser elements are symmetrically moved perpendicularly to a transportation direction.

17. An apparatus for applying labels to boxes, the apparatus defining a labeling zone for receiving a box having an upper side and having first and second opposing lateral sides, the apparatus comprising:

a label carrier for releasably carrying a label having a center portion and a first and second end portion, the label carrier is configured to be vertically moved along a vertical direction relative to said labeling zone to place the center portion of the label onto the upper side of a box received in the labeling zone; and a pressing assembly comprising two presser elements arranged on two mutually opposite lateral sides of the labeling zone, the presser elements being configured to be downwardly moved along the vertical direction both relative to the labeling zone and relative to the label carrier so as to fold the first and second end portions of the label onto the first and second lateral sides of the box, wherein the presser elements are further configured to be moved along a lateral direction running perpendicularly to the vertical direction relative to the labeling zone away from the first and second lateral sides of the box to increase a distance between the presser elements and to thereby release pressure from the first and second lateral sides of the box, and wherein the presser elements are elastically biased inwardly towards the first and second lateral sides of the labeling zone such that a lateral distance between the presser elements is smaller than a distance between the first and second laterals sides of the box during a downward movement of the pressure elements along the vertical direction.

18. The apparatus of claim 17, wherein at least one of:

i) the apparatus further comprises a pressure release mechanism comprising one or more pneumatic cylinders that are configured to move the presser elements such, that a horizontal distance between the presser elements is increased, and/or ii) the apparatus further comprises a distance regulation device and a spindle, wherein the distance regulation device is configured to drive the spindle such that the presser elements are symmetrically moved perpendicularly to a transportation direction.

19. A process of applying a label to a box having an upper side and having first and second opposing lateral sides, the process comprising the following steps, not necessarily in the present order:

transporting the box to a labeling zone;

fetching a label having a center portion and a first and second end portion from a label reservoir by a label carrier;

positioning the label above the box so that the first and second end portion laterally project beyond the lateral sides of the box;

placing the center portion of the label onto the upper side of the box by vertically moving the label carrier along a vertical direction; and folding the first and second end portions of the label onto the first and second lateral sides of the box by moving two presser elements arranged on two mutually opposite lateral sides of the labeling zone downward along the first and second lateral sides of the box, and releasing pressure from the lateral sides of the box by increasing the distance of the presser elements along a lateral direction running perpendicularly to the vertical direction relative to the labeling zone away from the first and second lateral sides of the box, wherein a horizontal distance between the presser elements is increased by means of a presser release mechanism such that in each case a lateral distance between the presser elements and the corresponding first lateral side and second lateral side of the box is increased equally over an entire length of the presser elements before the presser elements are moved upward again along the vertical direction while the presser elements are at said horizontal distance.

20. The process according to claim 19, wherein no adhesive is applied between the upper side of the box and the center portion of the label.

* * * * *